US006816690B2

(12) United States Patent
Yamamura

(10) Patent No.: US 6,816,690 B2
(45) Date of Patent: Nov. 9, 2004

(54) IMAGE FORMING APPARATUS AND METHOD OF DISCHARGING WASTE TONER

(75) Inventor: Akihiro Yamamura, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 10/355,620

(22) Filed: Jan. 31, 2003

(65) Prior Publication Data

US 2003/0231899 A1 Dec. 18, 2003

(30) Foreign Application Priority Data

Jun. 18, 2002 (JP) ..... 2002-176873

(51) Int. Cl.[7] ..... G03G 21/00

(52) U.S. Cl. ..... 399/129; 399/50; 399/100

(58) Field of Search ..... 399/50, 99, 100, 399/101, 127, 129, 149, 343, 357, 359; 430/35, 125, 902

(56) References Cited

U.S. PATENT DOCUMENTS 5,970,302 A * 10/1999 Yamane ..... 399/343

* cited by examiner

*Primary Examiner*—Hoang Ngo
(74) *Attorney, Agent, or Firm*—Akin Gump Strauss Hauer & Feld, L.L.P.

(57) ABSTRACT

An image forming apparatus includes a rotating photoconductive drum, charging roller, exposing unit, developing unit, transfer roller, cleaning blade, and controller. The charging member charges the surface of the photoconductive drum. The exposing unit illuminates the surface charged by the charging roller to form an electrostatic latent image. The developing unit develops the electrostatic latent image into a toner image. The transfer roller transfers the toner image onto a recording medium. The cleaning blade removes residual toner that failed to be transferred onto the recording medium. Prior to the discharge of deteriorated toner in the developing unit, the charging member charges the photoconductive drum which in turn charges the transfer roller. The toner discharged from the developing unit remains on the photoconductive drum when an area on the photoconductive drum passes by the transfer roller as the photoconductive drum rotates.

16 Claims, 7 Drawing Sheets

IMAGE FORMING APPARATUS AND METHOD OF DISCHARGING WASTE TONER

BACKGROUND OF THE INVENTION

1. Field of the Invention

The present invention generally relates to an image forming apparatus and more particularly to an image forming apparatus where waste toner can be collected without a power supply that generates a voltage for collecting waste toner from a photoconductive drum.

2. Description of the Related Art

A conventional image forming apparatus such as an electrophotographic printer and a copying machine performs an electrophotographic process. The electrophotographic process includes charging, exposing, developing, transferring, and fixing. The charging process is performed for storing charges on the photoconductive drum. The charges on the surface of the photoconductive drum are selectively dissipated in accordance with print data to form an electrostatic latent image. The electrostatic latent image is developed with toner into a toner image. The toner image is transferred onto a recording medium, and is then fused on the recording medium under heat and pressure into a permanent image.

A toner layer formed on the developing roller is attracted to the electrostatic latent image and some toner that failed to be deposited on the electrostatic latent image is returned to a toner chamber in the developing unit. The toner, returned into the toner chamber, is again used to form a toner layer on the developing roller. If a printing operation is repeatedly performed for print data having an image area in which toner occupies only very small areas on a page of the recording medium, only a small amount of toner is consumed and a large amount of unused toner is returned to the toner chamber. The unused toner is again used to form a toner layer on the developing roller. This operation is repeated many times.

Thus, the toner subjected to repetitive use is overcharged. Additionally, surface additives, which are added on the toner particles for adjusting an amount of charges and fluidity of toner, come off the toner particles. The surface additives that have come off sink in the toner particles. Thus, the toner particles clump into large agglomerates. The agglomerates of deteriorated toner particles cause non-uniform density of printed images, increased contamination of the recording medium, and missing dots, which in turn impair the print quality.

The aforementioned image forming apparatus is equipped with a mechanism that collects residual toner on the photoconductive drum resulting from normal printing operations. The mechanism discharges the collected residual toner, thereby eliminating problems resulting from deteriorated toner particles. This allows miniaturizing of a developing unit and facilitates maintenance of an image forming apparatus.

With the aforementioned conventional image forming apparatus, when the residual toner is collected, a cleaning member collects the residual toner from the photoconductive drum with the bias voltage of a transfer roller set to zero volts. Therefore, the toner deposited to the transfer roller and the surroundings within the image forming apparatus may contaminate the recording medium.

During transfer process, the transfer roller receives a bias voltage to transfer the toner image onto the recording medium. During a toner discharge process, the transfer roller receives a bias voltage of zero volts so that the residual toner remains on the photoconductive drum. The cleaning means in contact with the photoconductive drum collects the residual toner from the photoconductive drum.

However, merely setting the bias voltage of the transfer roller to zero volts is not enough to prevent the residual toner from being deposited to the transfer roller and the surroundings in the image forming apparatus. As a result, the toner image cannot be transferred thoroughly from the photoconductive drum during normal printing, and the toner deposited on the transfer roller and the surroundings can contaminate the recording medium.

SUMMARY OF THE INVENTION

The present invention was made in view of the aforementioned problems of the conventional image forming apparatus.

An object of the invention is to eliminate the need for providing a power supply that charges the transfer member during the toner discharging process.

Another object of the invention is to provide an image forming apparatus in which when residual toner is removed from an image bearing body, a charging member charges the image bearing body which in turn charges a transfer member so that toner is not deposited to a transfer member.

Another object of the invention is to provide an image forming apparatus in which residual toner is collected in a short time.

An image forming apparatus having at least one image forming section that includes a rotating image bearing body, a charging member such as a charging roller, an exposing unit, a developing unit, a transfer member such as a transfer roller, a toner removing member, and a controller. The charging member charges a surface of the image bearing body such as a photoconductive drum. The exposing unit illuminates the surface of the image bearing body charged by the charging member to form an electrostatic latent image on the surface. The developing unit holds toner therein and develops the electrostatic latent image with the toner into a toner image. The transfer member transfers the toner image from the image bearing body onto a recording medium. The toner removing member removes residual toner from the surface of the of the image bearing body after the toner image is transferred onto the recording medium. The controller performs a waste toner discharging operation. During the waste toner discharging operation, the controller controls the charging member to charge the surface of the image bearing body in such a way the charging member charges the image bearing body which in turn charges the transfer member. Then, the exposing unit illuminates the charged surface of the image bearing body. Finally, the developing unit supplies the toner to the illuminated surface, so that the toner supplied to the illuminated surface remains on the image bearing body when the toner on the illuminated surface on the image bearing body passes the transfer member as the image bearing body rotates.

The controller controls the charging member such that $|Vr|>|Vc|$, wherein Vr is a voltage applied to the charging member when the deteriorated toner is discharged, and Vc is a voltage applied to the charging member when a normal printing operation is performed.

The transfer member may be a transfer roller. During the waste toner discharging operation, at least one complete circumferential surface of the transfer roller has been charged before the toner on the image bearing body passes the transfer roller.

The transfer member may be a transfer belt. During the waste toner discharging operation, the transfer belt may be charged for a predetermined length of time before the toner is supplied to the illuminated surface of the image bearing body.

The controller controls the charging member such that $|Vr|>|Vc|$ when the transfer belt is charged for the predetermined length of time. The Vr is a voltage that applied to the charging member when the waste toner discharging operation is performed and Vc is a voltage applied to the charging member when a normal printing operation is performed.

The image forming section may be one of a plurality of image forming sections aligned along a path of the recording medium. The predetermined length of time is a time duration from when a point on the transfer belt is charged by an image forming section most downstream with respect to the path until it is charged by an image forming section most upstream.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein:

FIG. 5 is an equivalent circuit of FIG. 4 when the transfer bias power supply is turned on;

FIG. 11 is an equivalent circuit when the transfer bias power supply is turned on.

DETAILED DESCRIPTION OF THE INVENTION

Embodiments of the invention will be described in detail with reference to the accompanying drawings.

First Embodiment

Construction

Figure 1:
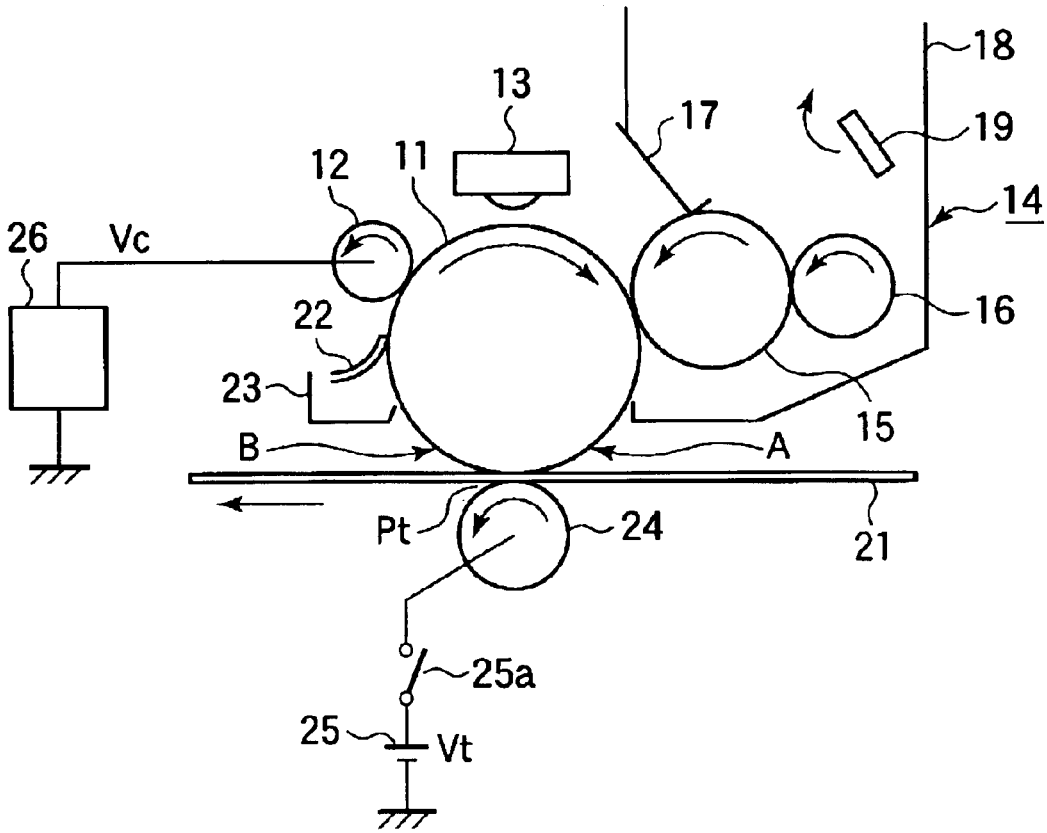
FIG. 1 is a side view, illustrating the general configuration of an image forming apparatus according to a first embodiment.

FIG. 1 is a side view, illustrating the general configuration of an image forming apparatus according to a first embodiment.

Referring to FIG. 1, a developing unit 14 is provided in an image forming apparatus such as an electrophotographic printer and a copying machine. The developing unit 14 includes a developing roller 15 for holding a thin toner layer thereon, and a toner-supplying roller 16 for supplying the toner to the developing roller 15. The developing roller 15 applies the toner to the electrostatic latent image formed on a photoconductive drum 11. The developing unit 14 also includes a toner reservoir 18 that holds the toner therein, a toner agitator 19 that agitates the toner in the toner reservoir 18, and a developing blade 17 that forms the thin layer of toner on the developing roller 15. The developing blade 17 extends in a longitudinal direction parallel to the developing roller 15 and is in pressure contact with the developing roller 15. The blade 17 receives a voltage from a power supply, not shown, to efficiently charge the toner. The toner agitator 19, toner-supplying roller 16, and developing roller 15 rotate in directions shown by arrows.

A charging roller 12 rotates in contact with the photoconductive drum 11 and controls the charging of the surface of the photoconductive drum 11. A non-contact type charging means that charges the photoconductive drum 11 by electrostatic discharge may be used in place of the charging roller 12. Under the control of a charging bias controller 26, the charging roller 12 receives a predetermined negative voltage during printing, and performs toner discharging operations to charge the photoconductive drum 11. An LED head 13 illuminates the charged surface of the photoconductive drum 11 to form an electrostatic latent image on the photoconductive drum 11.

A recording medium 21 is advanced in a direction shown by an arrow to pass a transfer point Pt defined between the photoconductive drum 11 and a transfer roller 24, so that the toner image on the photoconductive drum 11 is transferred onto the recording medium 21. Then, the recording medium 21 is further advanced to a fixing unit, not shown, that fuses the toner image on the recording medium 21 into a permanent image. The transfer roller 24 is made of, for example, an electrically conductive foamed silicone, and is disposed to oppose the photoconductive drum 11 with the recording medium 21 sandwiched between the transfer roller 24 and the photoconductive drum 11. A transfer bias power supply 25 applies, for example, a positive transfer bias voltage to the transfer roller 24 through a switch 25*a*.

A cleaning blade 22 extends in a longitudinal direction parallel to the photoconductive drum 11 and is in pressure contact with the surface of the photoconductive drum 11. During the printing operation, the cleaning blade 22 scrapes residual toner particles that failed to be transferred onto the recording medium 21 and remains on the photoconductive drum 11. The scraped toner particles are collected into a residual toner reservoir 23. Then, the residual toner particles are delivered from the residual toner reservoir 23 to a waste toner tank, not shown. The photoconductive drum 11, charging roller 12, and transfer roller 24 rotate in directions shown by arrows.

The image forming apparatus according to the first embodiment includes a controller, not shown, that includes an arithmetic unit such as a CPU and an MPU, a memory such as a semiconductor memory and a magnetic disk, and a communication interface. The controller controls the overall operation of the image forming apparatus.

Operation of the Apparatus

The overall operation of an image forming apparatus of the aforementioned configuration will be described.

First, the printing operation in which an image is printed on the recording medium 21 will be described. The toner, not shown, held in the aforementioned developing unit 14 is agitated and supplied to the developing roller 15 via the toner-supplying roller 16. The toner is negatively charged triboelectrically by the friction between the toner agitator 19, toner-supplying roller 16, and developing roller 15. The toner on the developing roller 15 is formed into a thin layer by the developing blade 17. The toner is further charged triboelectrically by the friction between the developing blade 17 and the developing roller 14 and by a voltage applied to the developing blade 17 from a power supply, not shown.

The charging roller 12 receives a negative bias voltage Vc, controlled by the charging bias controller 26, and charges the surface of the photoconductive drum 11. The photoconductive drum 11 rotates so that the charged surface reaches the exposing unit 13. The exposing unit 13 illuminates the charged surface of the photoconductive drum to form an electrostatic latent image on the photoconductive drum 11. Then, the photoconductive drum 11 further rotates so that the electrostatic latent image reaches the developing roller 15 where the developing roller 15 applies the toner to the electrostatic latent image to form a toner image.

The photoconductive drum 11 still further rotates, so that the toner image reaches the transfer roller 24 where the transfer roller 24 receives a transfer voltage Vt from the transfer bias power supply 25 to transfer the toner image onto the recording medium 21. Subsequently, the recording medium 21 having a toner image thereon passes through a fixing unit, not shown, where the toner image is fused into a permanent image. The recording medium 21 is then discharged from the image forming apparatus.

After transfer, the photoconductive drum 11 further rotates, so that the residual toner at position B downstream of the transfer point Pt with respect to rotation of the photoconductive drum 11 reaches the cleaning blade 22 and is scraped off by the cleaning blade 22. The scraped residual toner is collected into the toner-collecting reservoir and then delivered to a waste toner tank.

A waste toner discharging operation when printing is performed on extremely small areas (i.e., print duty is very low) on a page of recording medium will be described.

Figure 2:
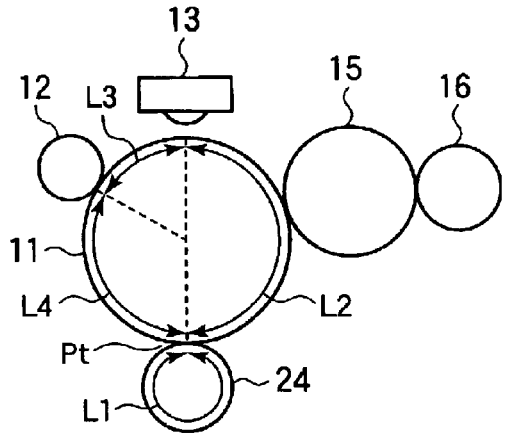
FIG. 2 illustrates the operation of the first embodiment in which the transfer roller is charged.

FIG. 2 illustrates the operation of the first embodiment in which the transfer roller is charged.

When printing is performed on a large number of pages with a low print duty, overcharged toner, insufficiently charged toner, and agglomerates of deteriorated toner will stay near the toner-supplying roller 16 and developing roller 15. In the first embodiment, prior to the waste toner discharging operation, the switch 25 a is switched off so that the transfer bias power supply 25 will not apply a transfer voltage Vt to the transfer roller 24. Then, the charging roller 12 charges the photoconductive drum 11 negatively, which in turn charges the transfer roller 24.

Referring to FIG. 2, L3 is a distance on the surface of the photoconductive drum 11 from the charging roller 12 to the exposing unit 13 in the rotational direction of the photoconductive drum 11. L2 is a distance on the surface of the photoconductive drum 11 from the exposing unit to the transfer roller 24. L1 is a distance on the transfer roller, traveling in a circumferential direction from the transfer point back to the transfer point. In order to charge the complete circumferential surface of the transfer roller 24, the surface of the photoconductive drum 11 requires to be charged over a distance at least equal to a distance L1+L3.

If the exposing unit 13 begins to illuminate the surface of the photoconductive drum 11 immediately after the charged surface of photoconductive drum 11 has rotated through a distance L1+L3, then an illuminated area reaches the transfer point shortly after the entire circumferential surface of the transfer roller 24 has been charged.

Figure 3:
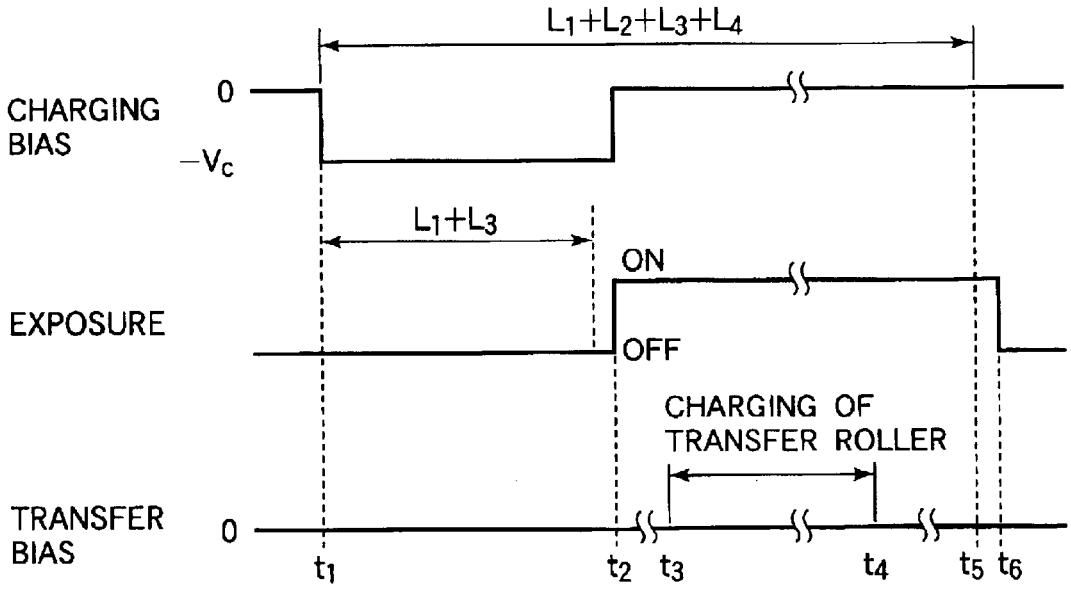
FIG. 3 is a timing chart, illustrating the operation for charging the transfer roller.

FIG. 3 is a timing chart, illustrating the relationship between the charging operation by the charging roller 12 and the exposing operation by the exposing unit.

The above-described charging operation implies that when the illuminated area having toner deposited thereon reaches the transfer roller 24, the complete circumferential surface of the transfer roller 24 has been negatively charged. Therefore, the negatively charged toner particles on the photoconductive drum 11 are not attracted to the negatively charged transfer roller 24 but remain on the photoconductive drum 11. The negatively charged toner particles are then scraped by the cleaning blade 22 off the photoconductive drum 11, and subsequently collected in the toner reservoir 23. Then, the toner in the waste toner reservoir 23 is delivered to the waste toner tank. The aforementioned timings at which the surface of the photoconductive drum 11 is charged and illuminated allow minimizing the time required for discharging waste toner.

In this case, the exposing unit illuminates the surface of the photoconductive drum 11 after the whole surface of the transfer roller 24 has been charged, i.e., after the complete circumferential surface of the transfer roller 24 is charged at least one time. The developing roller 15 applies the toner to the illuminated areas on the surface of the photoconductive drum 11. The cleaning blade 22 scrapes the residual toner off the surface of the photoconductive drum 11. Because the transfer roller 24 is charged to the same polarity (negative) as the toner, the toner on the photoconductive drum remains attracted to the photoconductive drum 11 and does not migrate to the transfer roller 24.

Prior to the discharge of waste toner, the entire charged surface of the photoconductive drum is exposed to light at an appropriate timing. If the charged surface of the photoconductive drum is exposed to light immediately after the charging roller 12 begins to charge the photoconductive drum 11, the toner remaining on the photoconductive drum 11 will reach the transfer roller 24 before the transfer roller 24 has been charged negatively yet. If the charged surface of the photoconductive drum 11 is exposed to light long after the charging roller 12 begins to charge the photoconductive drum 11, the whole surface of the transfer roller 24 will be reliably charged but the toner discharge operation takes too long a time. This causes the printing throughput of the image forming apparatus to decrease.

Transfer Bias Power Supply

Figure 4:
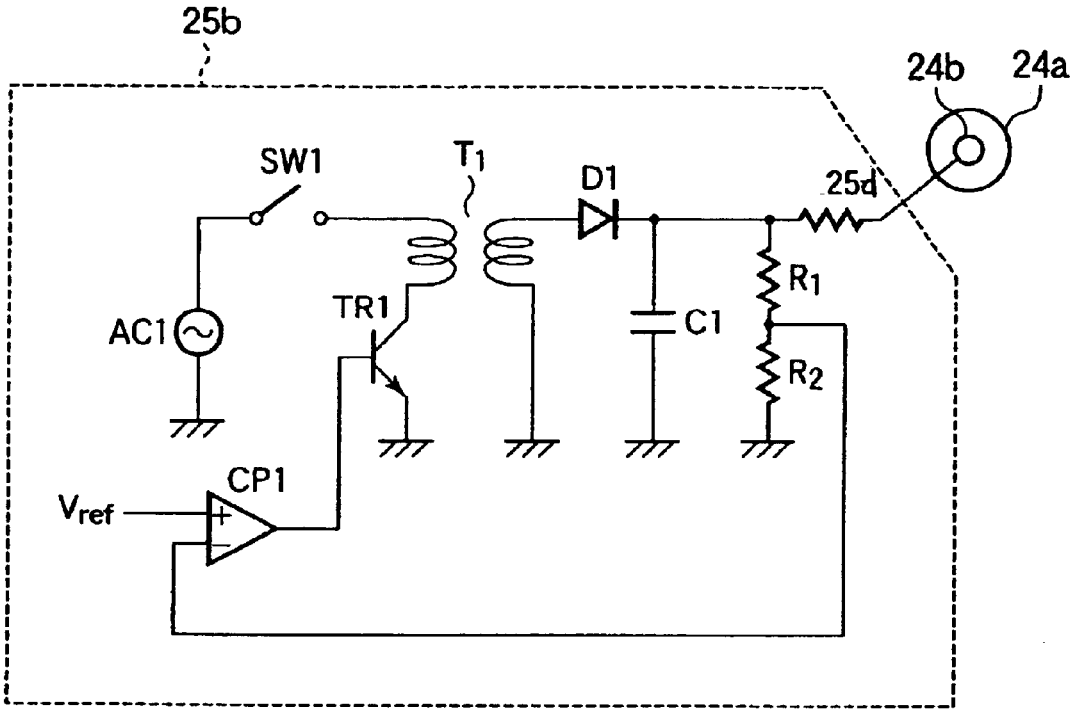
FIG. 4 illustrates a transfer bias power supply.

FIG. 4 illustrates a transfer bias power supply 25*b*.

Figure 5:
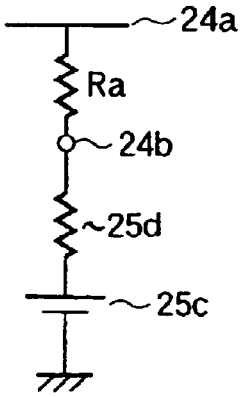

FIG. 5 is an equivalent circuit of FIG. 4 when the transfer bias power supply 25*b* is turned on.

A transfer bias voltage may be supplied from a transfer bias power supply as shown in FIG. 4 in which a power supply whose output voltage is switched on and off at the primary winding side of a transformer T1. When such a power supply is employed, the output resistance of the transfer bias power supply should be sufficiently high when the power supply is shut off. Additionally, the resistance of an intermediate medium (e.g., transfer roller) should be sufficiently high.

Referring to FIG. 4, the transfer bias power supply circuit 25*b* receives an a-c power from an a-c main line AC1. The transfer bias power supply circuit 25*b* includes a transformer T1, a rectifier D1, a smoothing capacitor C1, voltage dividing resistors R1 and R2, a reference voltage Vref, a comparator CP1, a control transistor TR1, an output switch SW1, and a series resistor R25*d*.

When a printing operation is performed, the switch SW1 is closed and a reference voltage Vref is inputted to the comparator CP1. The output of the a-c main line AC1 is transformed to a higher voltage by the transformer T1. The rectifier D1 rectifies the output of the transformer T1. The output of the rectifier D1 is smoothed out by the capacitor C1 into a d-c output, which in turn is supplied to the transfer roller 24. The voltage divider resistors R1 and R2 divide the d-c output 25*c* so that a portion of the output 25*c* is fed back to the input of the comparator CP1. If the voltage fed back is lower than the reference voltage Vref, then the comparator output causes the transistor TR1 to turn on. If the voltage fed back is higher than the reference voltage Vref, then the comparator output causes the transistor TR1 to turn off. Thus, the d-c output 25*c* of the transfer bias power supply is maintained constant. In other words, the d-c output 25*c* is supplied through a resistance Ra of the transfer roller 24 to the surface 24*a* of the transfer roller 24.

Figure 6:
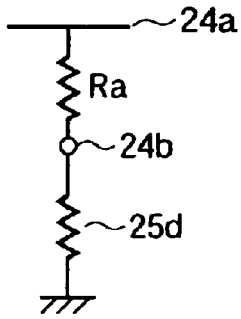
FIG. 6 is an equivalent circuit of FIG. 4 when the transfer bias power supply is shut off.

FIG. 6 is an equivalent circuit of FIG. 4 when the transfer bias power supply 25*b* is shut off.

When the waste-toner discharging operation is performed, the transfer bias power supply 25*b* is switched off. That is, the switch SW1 is opened to shut off the a-c main line AC1, so that the d-c output is not supplied to the roller 24. The transfer bias power supply has an equivalent resistance 25*d*. The shaft of the roller is connected to the ground through the roller resistor Ra and resistor 25*d* so that the charges on the surface of the roller 24 remain stored.

Modification

The apparatus may be configured so that the charging roller 12 receives a bias voltage having a higher absolute value during the waste toner discharging operation than during the normal printing operation. This modification of the waste toner discharging operation will be described.

Figure 7:
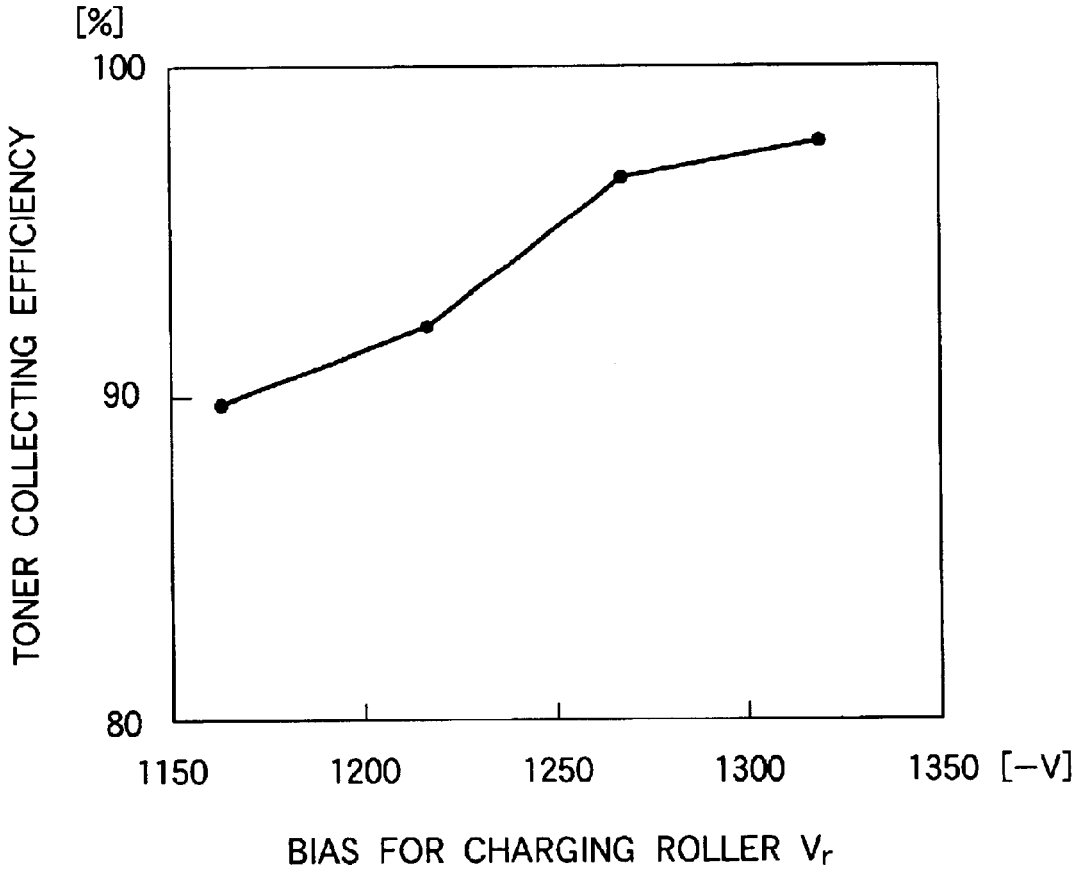
FIG. 7 illustrates the relationship between the toner collecting efficiency and the bias voltage applied to the charging roller.

FIG. 7 illustrates the relationship between the toner collecting efficiency and the bias voltage applied to the charging roller. FIG. 7 plots the bias voltage Vr as the abscissa and the toner collecting efficiency as the ordinate.

When the deteriorated toner is discharged, the charging roller 12 receives the bias voltage Vr from the charging bias controller 26. The absolute value of the bias voltage Vr during the waste toner discharging operation is larger than that of the bias voltage Vc applied to the charging roller 12 during printing, i.e., $|Vr|>|Vc|$. The overall operation is the same as that previously described except for the relationship between the absolute values of bias voltages applied to the charging roller 12.

Referring to FIG. 7, the toner collecting efficiency is the ratio of the toner weight at position A (FIG. 1) on the photoconductive drum 11 to the toner weight at position B (FIG. 1) when the toner discharging operation is performed.

Thus, when the toner is discharged, the charging bias controller 26 applies Vr to the charging roller 12 such that $|Vr|>|Vc|$. This voltage relationship increases the toner collecting efficiency. For example, an amount of toner collected is larger when Vr=−1325 V than when Vr=−1150 V.

The relationship in timings during the normal printing and during the waste toner discharging operation will be described.

Experiments were made as follows: The ratio of the number of printed dots to the number of printable dots is defined as print duty. When the print duty is greater than 3%, the deteriorated toner does not cause serious poor printing performance. Thus, the waste toner discharging operation is performed when printing duty is less than 3%.

The print duty is calculated as the sum of ratio of Dp(i) to Da(i) for i=1 to m, i.e., $$\sum_{i=1}^{m-1} \frac{Dp(i)}{Da(i)} \qquad \text{Eq. (1)}$$

where the number of printable dots of i-th page is Da(i), the number of printed dots of i-th page is Dp(i), and m is the number of pages. For normal printing, the print duty is calculated for several tens to about hundred pages of recording medium.

The amount of discharged toner Dr can be expressed in terms of the number of dots Dr as follows:

$$Dr = \frac{0.03}{1-0.03}\sum_{i=1}^{m-1} Da(i) - (1-0.03)\sum_{i=1}^{m-1} Dp(i) \qquad \text{Eq. (2)}$$

Increasing the bias voltage applied to the charging roller 12 allows a larger amount of toner to be collected into the waste toner reservoir, thereby decreasing the toner deposited to the transfer roller 24 and the surroundings.

The waste toner discharging operation is performed at timings based on the print duty, thereby discharging the deteriorated toner properly.

Second Embodiment

Elements and operation in a second embodiment similar to those of the first embodiment are omitted the description thereof.

Construction

Figure 8:
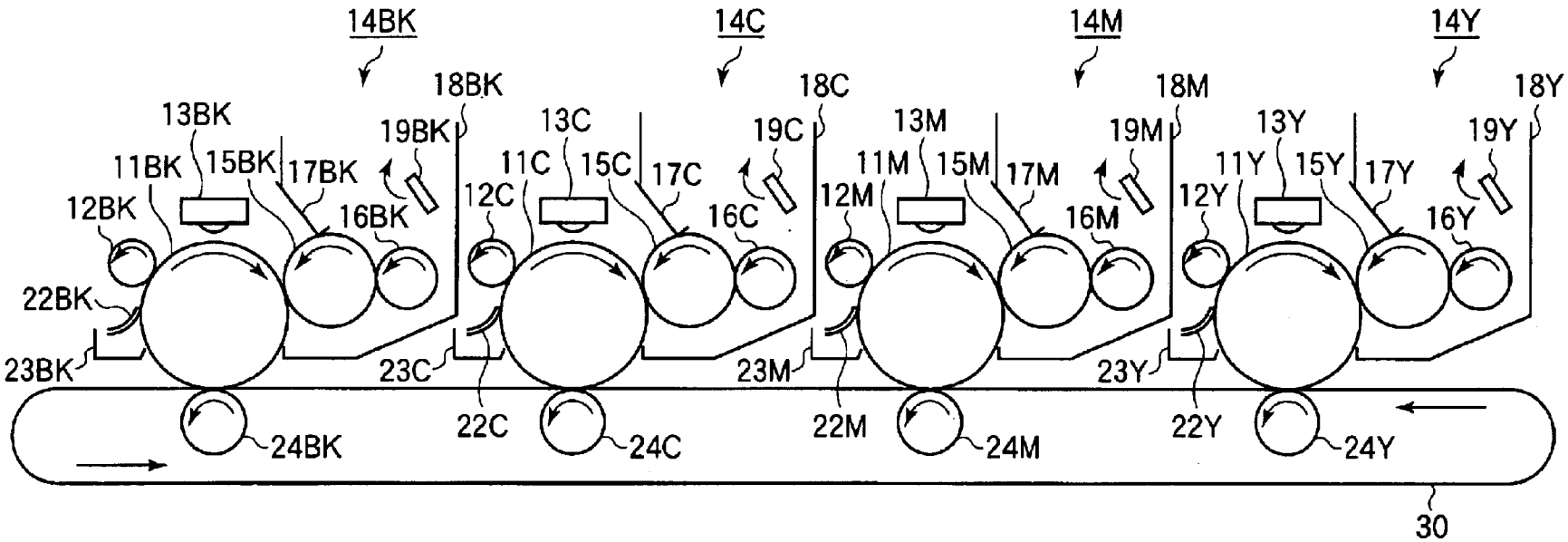
FIG. 8 illustrates a general view of a color image forming apparatus according to a second embodiment.

FIG. 8 illustrates a general view of an image forming apparatus according to the second embodiment.

As shown in FIG. 8, the image forming apparatus according to the second embodiment is a tandem type color image forming apparatus, which includes a plurality of image forming sections for forming yellow, magenta, cyan, and black images, respectively.

A transfer belt 30 is made of polyamide. The image forming sections for yellow, magenta, cyan, and black are aligned along the transfer belt 30 in this order, from up stream to down stream with respect to the transportation of the recording medium. Thus, yellow, magenta, cyan, and black toner images are transferred onto the recording medium in sequence.

Overall Operation

The operation of the color image forming apparatus of the aforementioned configuration will be described.

A printing operation will first be described with respect to an image forming section for yellow by way of example.

A toner agitator 19Y agitates the toner in the respective developing unit 14Y, and a toner supplying roller 16Y supplies yellow toner to a developing roller 15Y. The yellow toner is subjected to the friction between the toner supplying roller 16Y and developing roller 15Y. A developing blade 17Y forms a thin layer of yellow toner on the developing roller 15Y. The yellow toner is charged by not only the friction between the developing roller 15Y and developing blade 17Y but also the voltage applied to the developing blade 17.

A charging roller 12Y receives a voltage Vc from a charging bias controller, not shown, and charges the photoconductive drum 11Y. As the photoconductive drum 11Y rotates, the charged area on the photoconductive drum 11Y reaches an exposing unit 13Y where the exposing unit 13Y illuminates the charged area selectively in accordance with print data to form an electrostatic latent image. Then, the photoconductive drum 11Y further rotates so that the electrostatic latent image reaches the developing unit 14Y where the electrostatic latent image is developed into a toner image.

Then, the photoconductive drum 11Y still further rotates so that the toner image reaches a transfer roller 24Y that receives a transfer voltage from a transfer bias power supply, not shown. The transfer roller 24Y transfers the toner images onto a recording medium. The recording medium passes through the image forming sections of the respective colors, so that toner images of the respective colors are transferred onto the recording medium in sequence. Then, the recording medium advances to a fixing unit, not shown, where the toner images are fused into a permanent image.

A cleaning blade 22Y scrapes the residual toner off the photoconductive drum 11Y to collect the residual toner into a waste toner reservoir 23Y. The residual toner is then delivered to a waste toner tank, not shown.

Waste Toner Discharging Operation

The waste toner discharging operation will now be described.

Figure 9:
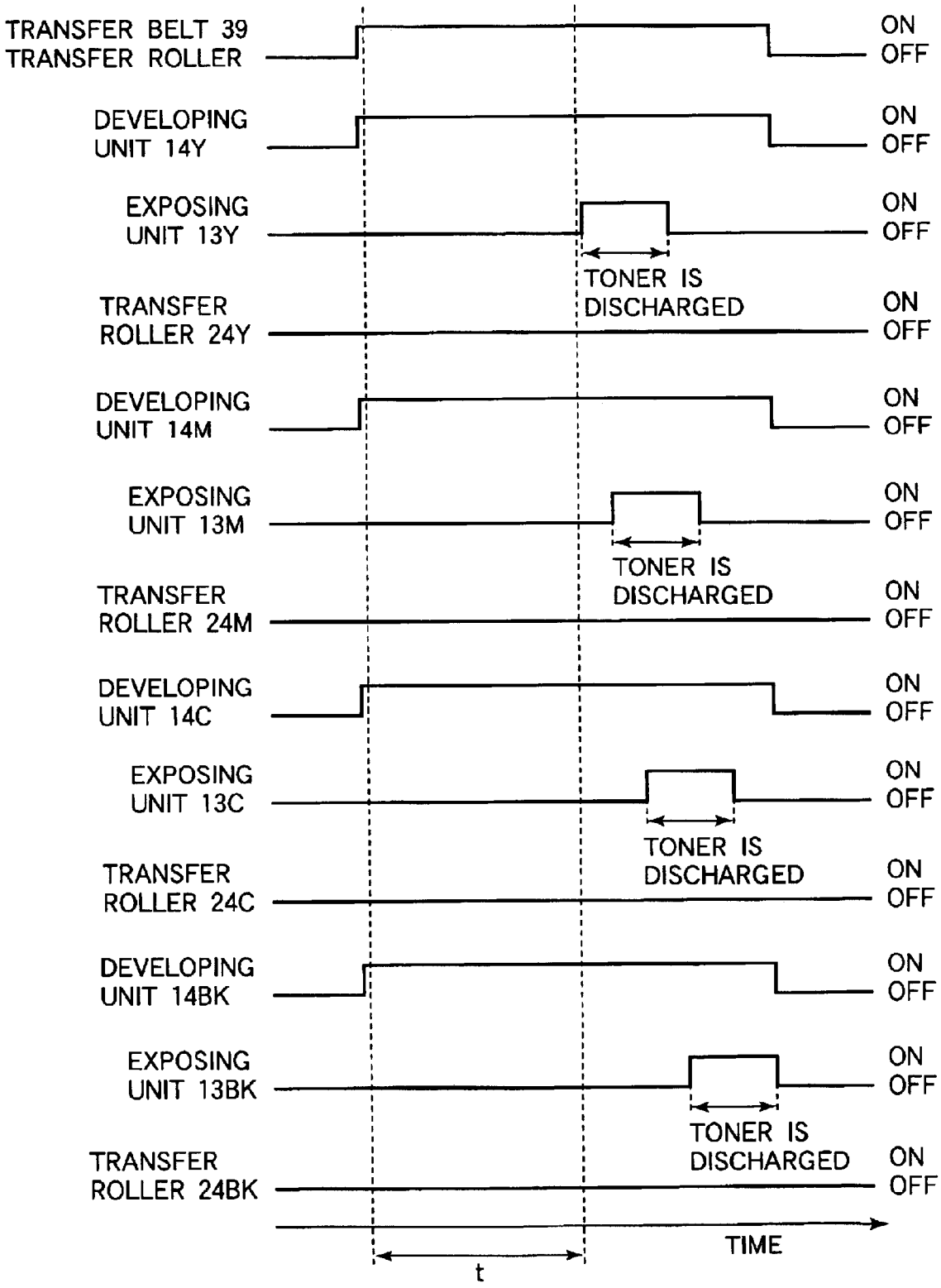
FIG. 9 is a timing chart, illustrating the operation of a color image forming apparatus according to the second embodiment.

FIG. 9 is a timing chart, illustrating the operation of a color image forming apparatus according to the second embodiment.

Figure 10:
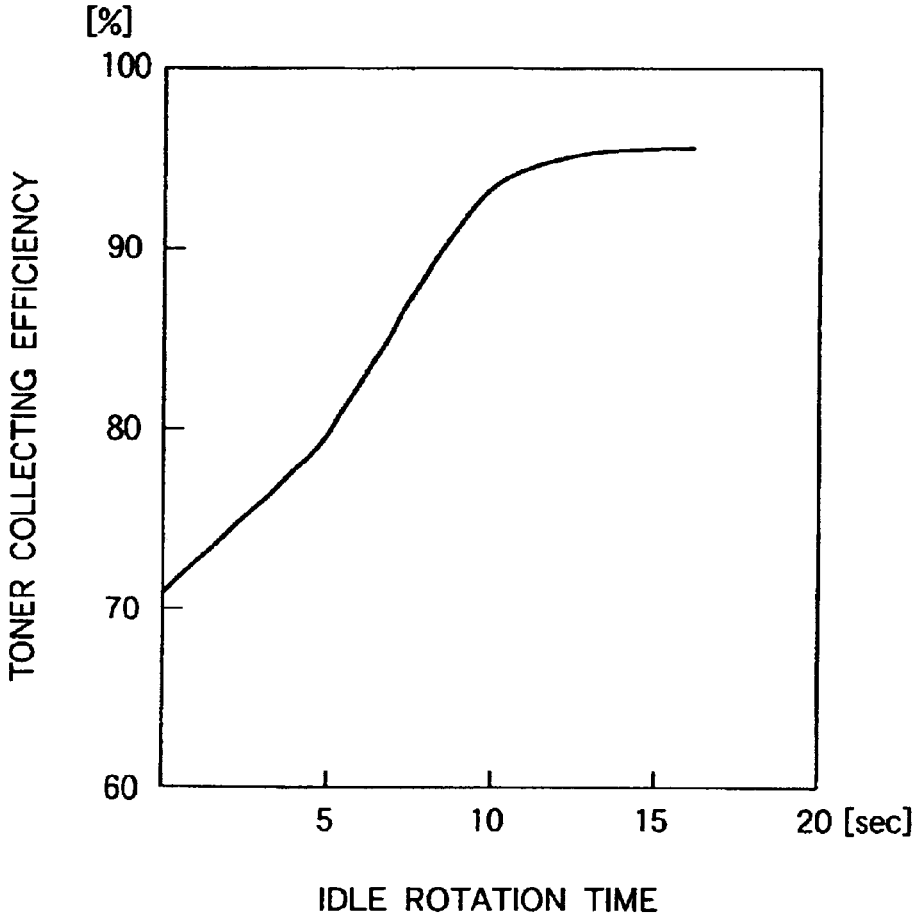
FIG. 10 illustrates the relationship between the idle rotation time and toner collecting efficiency.

FIG. 10 illustrates the relationship between the idle rotation time and toner collecting efficiency. FIG. 10 plots the idle rotation time as the abscissa and the toner collecting efficiency as the ordinate.

A predetermined bias voltage Vc is applied to the charging rollers 12Y, 12M, 12C, and 12BK which in turn charge the photoconductive drums 11Y, 11M, 11C, and 11BK, respectively. The respective structural members in the developing units 14Y, 14M, 14C, and 14BK are operated in an idle manner for a time length without exposure. During the idle rotation, the transfer belt 30 is charged. The idle rotation time t is given by the following equation.

$$t=Lb/Vb$$

where Lb is a distance equal to the circumference of the transfer belt 30 and Vb is a circumferential speed of the transfer belt 30.

FIG. 9 is a timing chart, illustrating the relationship between the states of the developing units 14Y, 14M, 14C, and 14BK, transfer rollers 24Y, 24M, 24C, 24BK, and exposing units 13Y, 13M, 13C, and 13BK.

The electrostatic latent images formed on the photoconductive drums 11Y, 11M, 11C, and 11BK are developed with the thin layers of toners of the respective colors into solid toner images. The transfer rollers 24Y, 24M, 24C, and 24BK receive zero volts, so that the solid toner images formed on the photoconductive drums 11Y, 11M, 11C, and 11BK are not transferred to the transfer belt 30 but collected into the waste toner reservoirs 23Y, 23M, 23C, and 23BK. Thus, the waste toners do not contaminate the transfer belt 30. Then, the collected waste toners are delivered to the waste toner tanks for respective colors.

The timing at which the waste toner discharging operation takes place is similar to that in the first embodiment. In other words, the waste toner discharging operation is performed when the print duty is less than 3% for several tens to about 100 pages of recording medium.

FIG. 10 illustrates the relationship between the toner collecting efficiency and the idle rotation time when the waste toner discharging operation takes place.

Toner collecting efficiency is the ratio of the toner weight at position B (FIG. 1) to the toner weight at position A (FIG. 1).

The graph in FIG. 10 reveals that the toner collecting efficiency increases with increasing idle rotation time. This is due to the fact that the charged surfaces of the photoconductive drums charge the transfer belt 30 a plurality of times during the idle rotation time. In general, charging the belt 30 one time is not sufficient to completely charge the transfer belt 30 to the potential of the photoconductive drums 11Y, 11M, 11C, and 11BK. Charging the transfer belt 30 a plurality of times through the photoconductive drums causes the potential of the transfer belt 30 to increase sufficiently. As a result, the negative potential of the transfer belt 30 can repel sufficiently the negatively charged toner particles on the photoconductive drums, thereby effectively preventing the toner particles from migrating to the transfer belt 30.

In the second embodiment, a plurality of image forming sections are aligned along the transfer belt 30 and therefore the respective image forming sections charge the transfer belt 30 different times. A point on the transfer belt 30 is charged a plurality of times from when the point is charged by the most downstream image forming section with respect to the direction in which the transfer belt 30 runs until it is charged by the most upstream image forming section. Thus, FIG. 10 plots as the abscissa the idle rotation time rather than number of times by which the transfer belt 30 is charged. Nevertheless, it should be understood that toner collecting efficiency improves with increasing number of times of charging.

Printing was performed with a print duty of 100%, the speed of transfer belt 30 was 130 mm/sec, and the circumference of the transfer belt 30 was 725 mm.

In the second embodiment, charging of the transfer belt 30 continues from when a point on the transfer belt 30 passes the most downstream image forming section until the point reaches the most upstream image forming section. Alternatively, charging of the transfer belt 30 may continue from when a point on the transfer belt 30 is charged by an upstream one of two adjacent image forming sections until the point on the transfer belt 30 reaches the downstream one of the two adjacent image forming sections. Therefore, every point of the transfer belt 30 is charged at least one time, thereby improving the toner collecting efficiency. The toner collecting efficiency is improved by performing the idle rotation of the transfer belt 30 for a time length required for the transfer belt 30 to travel at least half or longer than the circumference of the transfer belt 30. Just as in the first embodiment, the toner collecting efficiency can also be improved by setting the bias voltage applied to the charging rollers to a higher voltage during the waste toner discharging operation than during the normal printing operation.

The first and second embodiments have been described with respect to a case where the charging roller charges the photoconductive drum. Instead of by the charging roller, the photoconductive drum may also be charged by a stationary member that receives a voltage from the charging bias power supply and is in contact with the photoconductive drum. Still alternatively, a cleaning member that receives a negative voltage and is in contact with the photoconductive drum may be used to charge the photoconductive drum.

The present invention may also be applied to an intermediate transfer type image forming apparatus, in which case, the intermediate transfer material is charged by the photoconductive drum which in turn charges a secondary transfer member. Thereafter, the secondary transfer member receives the waste toner and a cleaning member scrapes the residual toner off the secondary transfer member.

Moreover, a transfer bias voltage may be supplied from a power supply as shown in FIG. 4 in which a power supply whose output is switched on and off at the primary winding side of a transformer T1. When such a power supply is employed, the resistance of an intermediate medium (e.g., belt) should be sufficiently high.

Figure 11:
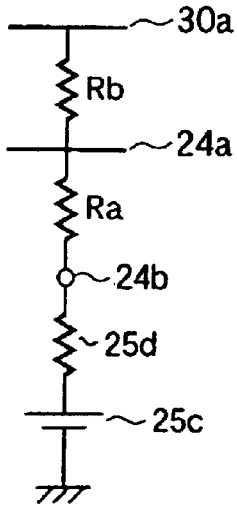

FIG. 11 is an equivalent circuit when the transfer bias power supply 25*b* is turned on. The d-c output 25*c* of the transfer bias power supply 25*b* is supplied to the surface 30*a* of the transfer belt 30 through the resistance Ra of the roller 24 and the resistance Rb of the transfer belt 30.

Figure 12:
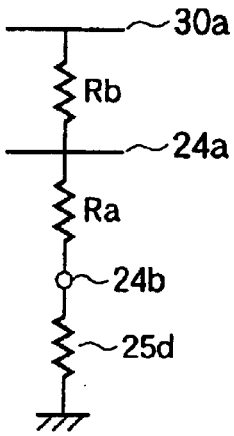
FIG. 12 is an equivalent circuit when the transfer bias power supply is turned off.

FIG. 12 is an equivalent circuit when the transfer bias power supply 25*b* is turned off.

When the waste toner discharging operation is performed, the transfer bias power supply 25*b* is switched off. That is, the switch SW1 is opened to shut off the a-c main line AC1, so that the d-c output is not supplied to the transfer roller 24. The transfer bias power supply has an equivalent resistance 25*d*. The surface of the transfer belt 30 is connected to the ground through the resistance Rb of the transfer belt 30, the resistance Ra of the transfer roller 24, and resistance 25*d* of the power supply, so that the charges on the surface of the roller 24 is maintained.

If an air gap is created between the transfer belt 30 and the transfer roller 24 during the waste toner discharging operation, the air gap exhibits a very high resistance so that charges can be stored on the surface of the transfer belt 30. In this case, the roller need not be made of an insulating material.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. An image forming apparatus having at least one image forming section, wherein the image forming section comprising:

a rotating image bearing body;

a charging member that charges a surface of said image bearing body;

an exposing unit that illuminates the surface of said image bearing body charged by said charging member to form an electrostatic latent image on the surface of said image bearing body;

a developing unit that develops the electrostatic latent image into a toner image;

a transfer member that transfers the toner image onto a recording medium;

a toner removing member that removes residual toner from the surface of said of said image bearing body after the toner image is transferred onto the recording medium; and a controller that performs a toner discharging operation wherein when said image bearing body rotates, said controller controls said charging member to charge the surface of said image bearing body, then the charged surface of said image bearing body rotates to oppose said transfer member to charge a surface of said transfer member, then said exposing unit illuminates the charged surface of the image bearing body, and finally said developing unit supplies the toner to the illuminated surface, wherein the illuminated surface of said image bearing body rotates past said transfer member to said toner removing member with the toner adhering to the illuminated surface of said image bearing body.

2. The image forming apparatus according to claim 1, wherein said controller controls said charging member such that $|Vr|>|Vc|$, wherein Vr is a voltage applied to said charging member when the toner discharging operation is performed, and Vc is a voltage applied to said charging member when a normal printing operation is performed.

3. The image forming apparatus according to claim 2, wherein said transfer member is a transfer roller, wherein during the toner discharging operation, at least one complete circumferential surface of the transfer roller has been charged before the toner on the image bearing body passes the transfer roller.

4. The image forming apparatus according to claim 2, wherein said transfer member is a transfer belt, wherein during the toner discharging operation, the transfer belt is charged for a predetermined length of time before the toner is supplied to the illuminated surface of said image bearing body.

5. The image forming apparatus according to claim 4, wherein said controller controls said charging member such that $|Vr|>|Vc|$ when the transfer belt is charged for the predetermined length of time, wherein Vr is a voltage applied to said charging member when the toner discharging operation is performed and Vc is a voltage applied to said charging member when a normal printing operation is performed.

6. The image forming apparatus according to claim 5, wherein the image forming section is one of a plurality of image forming sections aligned along a path of the recording medium, wherein the predetermined length of time is a time duration from when a point on the transfer belt is charged by an image forming section most downstream with respect to the path until the point is charged by an image forming section most upstream.

7. The image forming apparatus according to claim 1, further comprising a power supply that supplies a voltage to said transfer member during a normal printing operation, wherein when said controller performs the toner discharging operation, said controller: (1) switches off said power supply and (2) causes said image bearing body to rotate in contact with said transfer member.

8. The image forming apparatus according to claim 7, wherein when the normal printing operation is performed, the toner is charged to a first polarity and said power supply supplies a voltage to said transfer member, the voltage having a second polarity opposite to the first polarity.

9. The image forming apparatus according to claim 1, wherein when said controller performs the toner discharging operation, said charging member charges the surface of said image bearing body to a same polarity as the toner and said image bearing body charges said transfer member to the same polarity as the toner.

10. An image forming apparatus, comprising:

a charging member that charges a surface of an image bearing body;

a contact member that contacts the surface of the image bearing body charged by said charging member so that the image bearing body charged by said charging member charges a surface of said contact member; and a toner-supplying member that deposits toner to the surface of the image bearing body to form a toner image on the image bearing body;

wherein as the image bearing body rotates, toner on the surface of the image bearing body passes between the surface of the image bearing body and the surface of the contact member charged by the image bearing body, the charged surface of said contact member thereby reducing migration of the toner from the image bearing body to said contact member.

11. The image forming apparatus according to claim 10, wherein said contact member is a transport member that cooperates with the image bearing body to transport a recording medium.

12. The image forming apparatus according to claim 10, wherein said contact member is a transfer member that transfers the toner image from the image bearing body onto a recording medium.

13. The image forming apparatus according to claim 10, wherein the image bearing body charges said contact member before the toner image on the image bearing body reaches said contact member as the image bearing body rotates.

14. The image forming apparatus according to claim 10, wherein said contact member is connected through an impedance element to a member that is maintained at a potential of substantially zero volts.

15. The image forming apparatus according to claim 10, wherein said charging member charges the surface of said image bearing body to a same polarity as the toner and said image bearing body charges said contact member to the same polarity as the toner.

16. The image forming apparatus according to claim 10, comprising:

a power supply that supplies electric power to said contact member; and a toner removing member that removes toner from the surface of the image bearing body;

wherein when a normal printing operation is performed, said power supply supplies the electric power to said contact member so that the toner is transferred from the image bearing body to a recording medium sandwiched between the image bearing body and said contact member, and wherein when said toner removing member removes the toner form the image bearing body, said power supply is switched off.

* * * * *